US005099864A

United States Patent [19]

Young et al.

[11] Patent Number: 5,099,864

[45] Date of Patent: Mar. 31, 1992

[54] TOBACCO RECONSTITUTION PROCESS

[75] Inventors: Harvey J. Young, Advance; George W. Fearrington, Jr., Pfafftown, both of N.C.

[73] Assignee: R. J. Reynolds Tobacco Company, Winston-Salem, N.C.

[21] Appl. No.: 461,216

[22] Filed: Jan. 5, 1990

[51] Int. Cl.[5] ..... A24B 15/12

[52] U.S. Cl. ..... 131/372; 131/309

[58] Field of Search ..... 131/197, 198, 372, 370, 131/309

[56] References Cited

U.S. PATENT DOCUMENTS 3,353,541 11/1967 Hind et al. .
3,386,449 6/1968 Hind .
3,386,450 6/1968 Seligman et al. .
3,409,026 11/1968 Hind et al. .
3,411,514 11/1968 Hind et al. .
3,411,515 11/1968 Hind et al. .
3,420,241 1/1969 Hind et al. .
3,435,829 4/1969 Hind et al. .
3,464,422 9/1969 Light et al. .
3,483,874 12/1969 Hind .
3,616,801 11/1971 Hind .
3,746,012 7/1973 Deszyck .
3,760,815 9/1973 Deszyck .
4,674,519 6/1987 Keritsis et al. .
4,987,906 1/1991 Young et al. ..... 131/298

*Primary Examiner*—V. Millin

[57] ABSTRACT

Reconstituted tobacco material is provided by forming a slurry of tobacco dust in water and providing the slurry at a near neutral pH. The slurry is contacted with diammonium hydrogen orthophosphate, and the slurry is maintained at about 140° F. for about 1 hour. The pH of the slurry then is increased to about 8, and the slurry is maintained at about 180° F. for about 5 minutes. The slurry then is subjected to shear treatment, cast as a sheet, and dried. The resulting reconstituted tobacco material is useful as cut filler for cigarette manufacture.

24 Claims, 1 Drawing Sheet

TOBACCO RECONSTITUTION PROCESS

BACKGROUND OF THE INVENTION

The present invention relates to tobacco processing, and in particular, to a process for the manufacture of reconstituted tobacco materials.

Cigarettes are popular smoking articles which have a substantially cylindrical rod shaped structure and include a charge of tobacco material surrounded by a wrapper, such as paper, thereby forming a so-called "tobacco rod." It has become desirable to manufacture a cigarette having a cylindrical filter aligned in an end-to-end relationship with the tobacco rod. Typically, a filter includes cellulose acetate tow circumscribed by plug wrap, and is attached to the tobacco rod using a circumscribing tipping material. See, Baker, *Prog. Ener. Combust. Sci.*, Vol. 7 pp. 135–153 (1981).

Typical cigarettes include blends of various tobaccos, such as the flue-cured, Burley, Maryland and Oriental tobaccos. Cigarette blends also can include certain amounts of processed tobacco materials (e.g., reconstituted tobacco materials). Reconstituted tobacco materials often are manufactured from tobacco stems, dust and scrap using papermaking processes. See, *Tobacco Encyclopedia*, edit. by Voges, pp. 389–390, TJI (1984). It is known to provide reconstituted tobacco materials by chemically treating an aqueous slurry of small pieces of tobacco material, and forming the slurry into a sheet which then is shredded into cut filler form. See, U.S. Pat. Nos. 3,353,541 and 3,420,241 to Hind et al; 3,386,449 to Hind; 3,760,815 to Deszyck; 4,421,126 to Gellatly and 4,674,519 to Keritsis et al.

It would be desirable to provide a process for the efficient and effective manufacture of a reconstituted tobacco material having good physical characteristics and good smoking quality.

SUMMARY OF THE INVENTION

The present invention relates to a process for providing a reconstituted tobacco material. The process involves providing a slurry of tobacco material in a liquid having an aqueous character. The slurry is provided so as to have a near neutral pH. The slurry at near neutral pH is contacted with a water soluble phosphate salt. The slurry so provided is maintained at an elevated temperature relative to ambient temperature. The slurry can be heated to an elevated temperature after the phosphate salt is added thereto, or the phosphate salt can be added to a slurry which previously has been heated to an elevated temperature. Then, the slurry is provided so as to have a higher pH, and the temperature of the slurry is elevated to yet a higher temperature. Preferably, the slurry then is subjected to shear treatment. The resulting slurry, includes an effective amount of tobacco pectins released from the biopolymer matrix of the tobacco material. The tobacco pectins have binding properties. The resulting slurry then is formed into a desired shape (e.g., a sheet-like shape). The formed slurry then is dried to the desired moisture level, in order to provide a smokable reconstituted tobacco material.

The reconstituted tobacco material which is provided according to the process of the present invention can be employed using techniques known in the art. For example, the reconstituted tobacco material can be provided in sheet-like form having a thickness approximately that of tobacco leaf laminae; and the material can be blended with other tobacco materials, cut to the desired size, and employed as smokable cut filler for the manufacture of cigarettes.

DETAILED DESCRIPTION OF THE PREFERRED EMBODIMENTS

Figure 1:
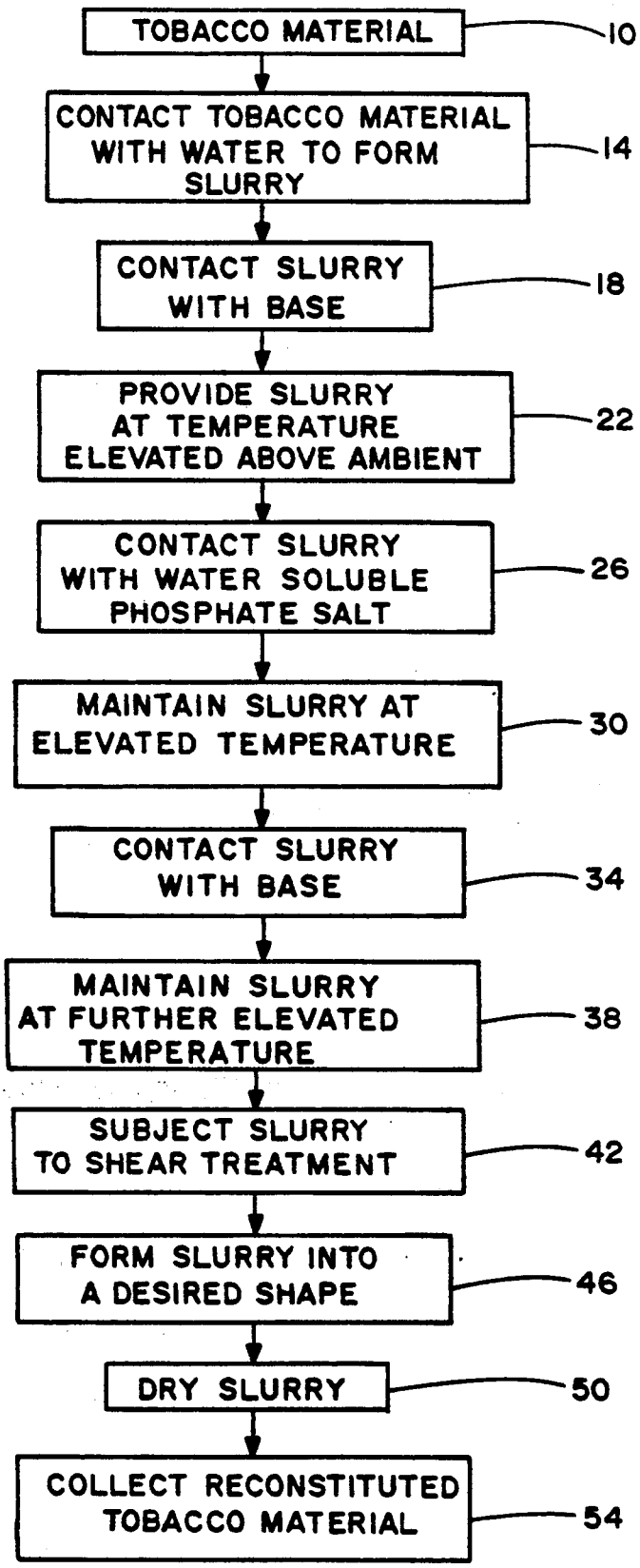
FIG. 1 is a schematic diagram of steps representative of an embodiment of the present invention.

Referring to FIG. 1, tobacco material 10 can have the form of stem, dust, strip, scrap, or the like. The tobacco material can be screened or otherwise processed to remove impurities (e.g., sand) therefrom. Techniques for removing particular impurities from particular tobacco materials can vary, depending upon factors such as the form of the tobacco material which is processed; and such techniques will be apparent to the skilled artisan.

The tobacco material 10 is contacted with a liquid having an aqueous character so as to form an aqueous tobacco slurry 14. The slurry normally exhibits a pH of about 5.0 to about 5.5.

The aqueous tobacco slurry 14 is contacted with a base 18, such as ammonia, so that the pH thereof is adjusted to near neutral. Typically, the pH of the slurry is increased to about 6 to about 8, and normally to about 6 to about 7, and preferably to slightly less than 7.

The slurry is provided at an elevated temperature 22 by heating the slurry. Typically, such an elevated temperature ranges from about 110° F. to about 160° F. Preferably, the slurry is agitated, using a mechanical stirrer or other suitable agitation means, while the slurry is heated. If desired, the slurry can be provided and maintained at an elevated temperature prior to the time that the pH of the slurry is increased (i.e., due to contact thereof with the base).

The slurry then is contacted with a water soluble phosphate salt 26. Typically, the slurry is contacted with an aqueous solution of a phosphate salt (e.g., diammonium hydrogen orthophosphate). During the period that the water soluble phosphate salt and slurry are contacted with one another, it is preferable to monitor the pH and temperature of the slurry. In particular, it is preferable to provide adequate adjustments to the slurry so as to maintain the slurry within the desired pH range and at the desired elevated temperature during the contact period.

The slurry then is maintained at an elevated temperature 30. Such an elevated temperature is above ambient temperature (i.e., ambient temperature is about 60° F. to about 90° F.). Typically, such an elevated temperature ranges from about 110° F. to about 160° F., preferably about 130° F. to about 150° F. Normally, the slurry is maintained at the elevated temperature for a period of about 20 minutes to about 3 hours, preferably about 30 minutes to about 2 hours. Typically, when the slurry is maintained at a fairly high elevated temperature, the slurry can be maintained at that temperature for a relatively short period. The optimum period over which a particular slurry is maintained at a particular elevated temperature can be determined by experimentation. Preferably, the slurry is agitated during the time that it is maintained at the elevated temperature. The agitation can vary from gentle mechanical mixing to high shear mixing (e.g., homogenization). The slurry is maintained at an elevated temperature for a period sufficient to allow the water soluble phosphate salt to penetrate the water insoluble portion of the tobacco material, and initiate destruction of alkaline earth metal crosslinks within the tobacco pectins. During such a period, the pH of the slurry often has a tendency to decrease slightly; and as such, a base (e.g., ammonia) often is incorporated into the slurry in order to maintain the slurry at a near neutral pH.

The slurry then is contacted with a further amount of base 34 so that the pH thereof is further increased to above 7, preferably about 7.5 to about 9. Then, the slurry is provided at a further elevated temperature 38. Typically, such a further elevated temperature is above about 140° F., and preferably ranges from about 160° F. to about 190° F. However, the further elevated temperature is at least 20° F. above the previous elevated temperature. The time over which the slurry is subjected to the further elevated temperature can vary. However, the slurry is normally maintained at the further elevated temperature for a period of about 5 minutes to about 1 hour, preferably about 10 minutes to about 30 minutes. Preferably, the slurry is agitated during the time that it is maintained at the further elevated temperature. The slurry is maintained at the further elevated temperature in order to promote (i) further destruction of the alkaline earth metal crosslinks within the tobacco pectins, (ii) release and migration of the tobacco pectins from the water insoluble portion of the tobacco material, and (iii) make available the binding properties of the tobacco pectins.

The previously described process steps can be performed by processing each successive aqueous slurry in a batch-wise manner.

The previously described process steps can be performed by processing the slurry in a continual or semi-batch-wise manner. An aqueous tobacco slurry in contact with a water soluble phosphate salt is maintained at an elevated temperature and at near neutral pH. To that slurry is added, in a continuous manner, a fresh aqueous tobacco slurry at near neutral pH and water soluble phosphate salt. As fresh slurry is introduced to the slurry, a portion of the slurry which has been maintained at the elevated temperature is taken away, preferably at the same rate of introduction of the fresh slurry and phosphate salt. As such, the average residence time that the slurry is maintained at the elevated temperature can be selected as desired. A typical average residence time is about 1 hour. Normally, the slurry which is taken away is passed through a coiled process line into which gaseous ammonia is introduced at a controlled rate in order to further increase the pH of that slurry. The slurry within the process line then is heated further so as to subject the slurry to a further elevated temperature.

The slurry then is subjected to shear treatment 42, particularly if gentle agitation is employed during the earlier steps of the process. For example, the slurry, which is provided at the further elevated temperature, is passed through a shear mixer. Such shear treatment promotes yet further release and migration of the tobacco pectins from the biopolymer matrix of the tobacco.

The processed slurry then is formed into a predetermined or desired shape 46. Normally, the slurry is formed into a sheet-like shape. For example, the slurry is cast, or otherwise coated, at the desired thickness onto a moving impervious metal belt. The resulting formed slurry then is dried 50. Usually, drying of the formed slurry is accomplished by heat treatment, such as by air drying or heating the formed slurry for a period sufficient to provide a reconstituted tobacco material having a moisture content of about 10 to about 20 weight percent, preferably about 12 to about 14 weight percent. Then, the resulting reconstituted tobacco material is collected 54.

Tobacco materials used in performing the process of the present invention can vary. However, the tobacco materials which are reconstituted according to the process of the present invention are of a form such that a portion thereof is soluble in a solvent having an aqueous character and a portion thereof is insoluble in that solvent. Suitable types of tobaccos include flue-cured, Burley, Maryland and Oriental tobaccos, although other types of tobaccos can be employed. The tobacco material generally has been aged. The tobacco material can be in a processed form. The tobacco material can be employed in the form of dust, fines, stems, strip laminae, cut filler, scrap, processing by-products, or the like. Although the size of the individual particles or pieces of tobacco material can vary, it is preferable that the particles or pieces be less than about 14 US Mesh in size. The aforementioned types of tobaccos and forms of tobacco material can be processed separately, or as blends thereof. For example, a minor amount of shredded tobacco stems can be blended with particles or pieces of tobacco laminae.

The tobacco material is contacted with a liquid having an aqueous character. Such a liquid consists primarily of water, normally greater than 90 weight percent water, and can be essentially pure water in certain circumstances. Essentially pure water includes deionized water, distilled water and tap water. However, the liquid can include water having substances, such as humectants, flavors (e.g., sugars, cocoa and licorice) and preservatives, incorporated therein. The liquid also can be a mixture of water and minor amounts of at least one other liquid miscible therewith. For example, a liquid having an aqueous character can be a mixture of 95 weight parts water and 5 weight parts ethanol.

The amount of tobacco material which is contacted with the liquid can vary. Typical slurries are provided by contacting about 4 to about 12, preferably about 4 to about 8, weight parts of liquid per weight part of tobacco material. Generally, slurries of relatively low liquid content can be provided using a tobacco material of relatively small particle size. The manner of contacting the tobacco material with the liquid is not particularly critical. The liquid can be heated to the desired elevated temperature prior to the time that the tobacco material is contacted therewith, or a slurry of tobacco material and liquid can be provided and then heated to the elevated desired temperature.

The slurry is contacted with ammonia, or any other suitable basic reagent capable of providing the slurry within the desired pH range. The ammonia can be anhydrous ammonia, and can be bubbled through the slurry. Alternatively, a concentrated ammonium hydroxide solution can be contacted with the slurry. The amount of basic reagent required to provide the slurry within the desired pH range will be apparent to the skilled artisan.

The slurry is contacted with a water soluble phosphate salt. Such salts include diammonium hydrogen orthophosphate, ammonium dihydrogen orthophosphate, potassium dihydrogen phosphate, tripotassium phosphate, and the like. If desired, the salt can be formed in situ by separately introducing phosphoric acid and ammonia into the slurry. The amount of phosphate salt which is contacted with the slurry can vary. For example, for a salt such as diammonium hydrogen orthophosphate, about 35 g to about 80 g, preferably about 50 g to about 65 g of salt is contacted with each kilogram of tobacco material. Preferably, the salt is dissolved in a liquid having an aqueous character, and the resulting salt solution is contacted with the slurry.

The heated slurry most preferably is subjected to shear treatment. By the term "shear treatment" is meant very rapid agitation or mixing at rates comparable to a mixing blade operating at a rotor speed above about 1,000 rpm, and more frequently above about 2,000 rpm. Such treatment provides high agitation and can occur over a relatively brief period. Typical high shear treatments of the slurry can be performed in less than about 30 seconds. Exemplary apparatus for providing shear treatment include the Fitzmill Comminutor Model No. DKAS06 from The Fitzpatrick Co.; and the Reeves XV Motordrive operated at 5,000 to 10,000 rpm and with a screen size of 0.016 to 0.070.

The processed slurry is formed into the desired or predetermined shape. Normally, the slurry is cast as a sheet. Methods for casting a slurry as a sheet will be apparent to the skilled artisan. Normally, the slurry has a temperature of about 140° F. to about 180° F. when it is formed into the predetermined shape. Typically, the slurry, which normally has a tobacco solids content of about 14 to about 20 weight percent, is cast as a sheet having a thickness of about 15 mil to about 40 mil, preferably about 25 mil. Then, the cast slurry is dried to the desired moisture level. Drying of the cast slurry can be provided using a variety of techniques. For example, the cast slurry can be (i) air dried under ambient conditions, (ii) heated on a heated metal surface, (iii) subjected to contact with heated air, or (iv) heated on a heated metal surface and subjected to contact with heated air.

The resulting dried reconstituted tobacco material is collected. The reconstituted tobacco material is flexible, exhibits good wet strength, and can be easily cut or shredded into cut filler form. The reconstituted tobacco preferably has the form of a sheet having a weight of about 75 g/m$^2$ to about 150 g/m$^2$. The reconstituted tobacco material exhibits a mild smoking character. The reconstituted tobacco material normally is blended with other smokable materials. For example, for a cigarette blend, up to about 25 weight percent, preferably between about 5 and about 20 weight percent of the blend can be the reconstituted tobacco material which is prepared according to the process of the present invention.

The processed slurry can be formed into forms or shapes other than a sheet-like shape. For example, the processed slurry can be sprayed, using casing techniques, onto other smokable materials, such as tobacco cut filler.

The following example is provided in order to further illustrate various embodiments of the invention but should not be construed as limiting the scope thereof. Unless otherwise noted, all parts and percentages are by weight.

EXAMPLE 1

About 106 l of tap water is charged into a 100 gallon capacity mixer Style CW manufactured by Hamilton Kettles, Cincinnati, Ohio. The water is agitated by operating the mixer at about 20 rpm. The water is heated to a temperature of 140° F. Then, about 24 kg of tobacco material is charged into the heated water. The tobacco material has the form of particles of tobacco dust which is collected as a process by-product during cigarette manufacture, and greater than 90 percent of the particles pass a 42 Mesh (Tyler) screen. The heated water is agitated at about 20 rpm while the tobacco dust is contacted therewith. As such, an aqueous tobacco slurry is provided. The slurry is maintained at about 140° F. The pH of the slurry is about 5.5.

The pH of the slurry is altered. In particular, about 400 ml of a concentrated ammonium hydroxide solution (i.e., 28 parts ammonia in 72 parts water) is charged into the slurry to raise the pH of the slurry to about 6.5.

About 1.33 kg of diammonium hydrogen orthophosphate is dissolved in 9.46 l of tap water. About 4.73 l kg of the resulting solution is added to the slurry over a 10 minute period. Then, the pH of the slurry is monitored, and sufficient concentrated ammonium hydroxide solution (e.g., about 170 ml) is added to the slurry to provide a slurry having a pH of about 6.5. Then, the remaining 4.73 l of the diammonium hydrogen orthophosphate solution is added to the slurry over a 10 minute period. The slurry then exhibits a pH of about 6.6. The slurry is continued to be maintained at 140° F.

The slurry then is continued to be agitated at about 20 rpm, and maintained at 140° F. for about 1 hour. Then, the pH of the slurry is adjusted to about 8 to about 8.2 as a result of the addition of about 1,200 ml concentrated ammonium hydroxide solution. Then, over a 10 to 12 minute period, the slurry is heated to about 180° F. The slurry is maintained at about 180° F. for about 5 minutes.

The heated slurry then is passed twice through a Fitzmill Comminutor Model No. DKAS06 operating at a no load rotor speed of about 3,100 rpm, and equipped with a 28 Mesh (Tyler) screen. The resulting heated and sheared slurry is collected, and contained to minimize heat loss.

The heated slurry is cast as a sheet of about 25 mil thickness on a stainless steel belt maintained at about 225° F. As a result, the slurry is dried to a moisture level of about 14 percent on the steel belt moving at about 1.5 m/min. The resulting dried sheet exhibits a thickness of about 7 mil. The sheet then is collected.

The reconstituted tobacco sheet has a moisture content of about 14 percent, and a weight of about 95 g/m$^2$.

The sheet is shredded into cut filler form and used as cut filler for cigarette manufacture. The reconstituted tobacco cut filler exhibits good smoking properties, good ashing properties, and good flavor characteristics.

What is claimed is:

1. A process for providing a reconstituted tobacco material, the process comprising the steps of:
   (a) providing a slurry of tobacco material in a liquid having an aqueous character;
   (b) providing the slurry at a pH in the range of about 6 to about 8;
   (c) contacting the slurry with a water soluble phosphate salt;
   (d) maintaining the slurry at an elevated temperature relative to ambient temperature;
   (e) increasing the ph of slurry;
   (f) providing the slurry at a temperature above the elevated temperature; and
   (g) forming the slurry into a predetermined shape.

2. The process of claim 1 wherein the slurry is subjected to shear treatment after step (f) and prior to step (g).

3. The process of claim 1 or 2 wherein the slurry is provided at a pH between about 6 and about 7 in step (b).

4. The process of claim 3 whereby the elevated temperature relative to ambient temperature is between about 130° F. and about 150° F.

5. The process of claim 3 wherein by pH of the slurry is increased to a pH above 7 in step (e).

6. The process of claim 3 whereby the slurry is provided at a temperature between about 160° F. and about 190° F. in step (f).

7. The process of claim 3 whereby the slurry provided in step (a) includes about 4 to about 8 weight parts of liquid having an aqueous character per weight part of tobacco material.

8. The process of claim 1 or 2 whereby the elevated temperature relative to ambient temperature is between about 110° F. and about 160° F.

9. The process of claim 2 whereby the pH of the slurry is increased to between about 7.5 and about 9 in step (e).

10. The process of claim 1 or 2 further comprising drying the slurry formed in step (g) to a moisture level of about 10 to about 20 weight percent.

11. The process of claim 1 or 2 whereby the slurry is provided at a temperature above about 140° F. in step (f).

12. The process of claim 1 or 2 whereby the slurry is formed into a sheet-like shape in step (g).

13. The process of claim 1 or 2 whereby the slurry provided in step (a) includes about 4 to about 12 weight parts of liquid having an aqueous character per weight part of tobacco material.

14. The process of claim 11 whereby in step (f) the slurry is provided at a temperature at least about 20° F. above the elevated temperature.

15. The process of claim 1 or 2 whereby the water soluble phosphate salt includes diammonium hydrogen orthophosphate.

16. The process of claim 1 or 2 whereby the slurry is provided at an elevated temperature relative to ambient temperature prior to step (c).

17. The process of claim 1 or 2 whereby ambient temperature is between about 60° F. and about 90° F.

18. A process for providing a reconstituted tobacco material, the process comprising the steps of:

(a) providing a slurry of tobacco material in a liquid having an aqueous character;

(b) providing the slurry (i) at a pH in the range of about 6 to about 8;

(c) contacting the slurry with a water soluble phosphate salt;

(d) maintaining the slurry at a temperature between about 110° F. and about 160° F.;

(e) increasing the pH of the slurry;

(f) providing the slurry at a temperature at least about 20° F. above the temperature at which the slurry is maintained in step (d) and above about 140° F.; and (g) forming the slurry into a predetermined shape.

19. The process of claim 18 whereby the slurry is subjected to high shear treatment after step (f) and prior to step (g).

20. The process of claim 18 or 19 whereby the water soluble phosphate salt includes diammonium hydrogen orthophosphate.

21. The process of claim 18 or 19 whereby the slurry provided in step (a) includes about 4 to about 12 weight parts of liquid having an aqueous character per weight part of tobacco material.

22. The process of claim 18 or 19 whereby the slurry is formed into a sheet-like shape in step (g).

23. The process of claim 18 or 19 further comprising drying the slurry formed in step (g) to a moisture level of about 10 to about 20 weight percent.

24. The process of claim 18 or 19 whereby the slurry is provided at a temperature between about 110° F. and about 160° F. prior to step (c).

* * * * *